US005145304A

United States Patent [19]

Rosen

[11] Patent Number: 5,145,304

[45] Date of Patent: Sep. 8, 1992

[54] HEIGHT ADJUSTABLE VEHICLE PARKING APPARATUS

[75] Inventor: Arnold M. Rosen, Roslyn, N.Y.

[73] Assignee: Park Plus Corporation, New York, N.Y.

[21] Appl. No.: 613,121

[22] Filed: Nov. 14, 1990

[51] Int. Cl.[5] ..... B66F 7/04

[52] U.S. Cl. ..... 414/228; 414/234; 187/8.49; 187/8.5

[58] Field of Search ..... 414/227, 228, 233, 234, 414/229, 545; 187/9 R, 9 E, 8.47, 8.49, 8.5; 410/3, 4, 24, 26, 29.1

[56] References Cited

U.S. PATENT DOCUMENTS

| | | | |
|---|---|---|---|
| Re. 25,923 | 12/1965 | Powell | 187/8.49 X |
| 2,608,381 | 8/1952 | Pelouch | 187/8.49 |
| 4,331,219 | 5/1982 | Suzuki | 187/8.5 |
| 4,772,172 | 9/1988 | Rosen | 414/228 X |

FOREIGN PATENT DOCUMENTS

| | | | |
|---|---|---|---|
| 2347130 | 4/1975 | Fed. Rep. of Germany | 187/8.49 |
| 9011911 | 10/1990 | PCT Int'l Appl. | 414/234 |

*Primary Examiner*—Frank E. Werner
*Attorney, Agent, or Firm*—Anthony J. Casella; Gerald E. Hespos

[57] ABSTRACT

A height adjustable vehicle parking apparatus is provided. The apparatus comprises a base and a pair of upstanding stanchions. A vehicle parking platform is disposed between and moveable along the stanchions. An articulated stabilizer bar assembly comprising a rocker arm and a control arm are pivotally connected to one another and to the parking platform and base respectively. A piston and cylinder assembly extends pivotally from a fixed location on the articulated stabilizing bar assembly. Height adjustable means for supporting the vehicle platform at various heights are provided intermediate the upstanding stanchions. Thus, the subject parking apparatus may be employed in a variety of indoor parking facilities having different height limitations.

6 Claims, 3 Drawing Sheets

HEIGHT ADJUSTABLE VEHICLE PARKING APPARATUS

BACKGROUND OF THE INVENTION

A vehicle parking apparatus is employed for parking more than one vehicle in vertical relationship in the surface area that approximately corresponds to the area of a standard vehicle parking space. More particularly, a vehicle parking apparatus includes a platform onto which a vehicle is driven. Thereafter, the platform may be raised with the vehicle thereon to a sufficient height such that a second vehicle may be parked thereunder.

Vehicle parking apparatuses of this type are widely used in urban areas of the U.S. where the land available for parking vehicles is extremely limited and where property values and building costs are extremely high. As populations continue to increase in urban areas open space will become less available and vehicle parking problems will become more acute.

To date, the above described vehicle parking apparatus have been widely used in both open vehicle parking lots and enclosed vehicle parking garages. One extremely effective prior art vehicle parking apparatus is shown in U.S. Pat. No. 4,209,276 which issued to the applicant herein on Jun. 24, 1980 entitled "VEHICLE PARKING APPARATUS". The vehicle parking apparatus disclosed in U.S. Pat. No. 4,209,276 includes a base having a pair of spaced apart upstanding stanchions extending therefrom. The stanchions are spaced from one another a sufficient distance to enable a vehicle to be driven therebetween. A pair of hydraulic pistons and cylinder assemblies are rigidly mounted respectively to the stanchions to extend upwardly from the top of the stanchions. The pistons are connected to a platform or ramp onto which the vehicle may be driven. The platform is movable along the stanchions under the action of the hydraulic piston and cylinder assembly. Thus, the hydraulically actuated withdrawal of the pistons into the corresponding cylinders will lift the platform with the vehicle thereon a distance equal to the movement of the piston which must be sufficient to enable a second vehicle to be driven between the stanchions and under the platform. As a safety precaution, the stanchions comprise rigid integral supports welded thereto at a location corresponding to the maximum elevation of the platform. The platform then includes a latch for engaging the support on the stanchion when the platform attains its maximum elevation. To ensure that the vehicle on the platform is elevated evenly despite the possibility of uneven weight distribution in the vehicle the apparatus includes stabilizer bar linkages which extend from the base to the platform to stabilize the platform and to provide an even lifting of the vehicle.

Despite the many advantages of the vehicle parking apparatus disclosed in U.S. Pat. No. 4,209,276 the apparatus defined by the stanchions and the large pistons extending up from the stanchions occupies a total height of approximately 11'-4" which exceeds the floor to ceiling height in many parking structures.

Another vehicle parking apparatus which remedies the height problems inherent in U.S. Pat. No. 4,209,276 is disclosed in U.S. Pat. No. 4,772,172 which also issued to the applicant herein on Sep. 20, 1988 entitled "LOW PROFILE VEHICLE PARKING APPARATUS". The parking apparatus disclosed in U.S. Pat. No. 4,772,172 comprises a base and a pair of upstanding stanchions extending rigidly from the base, and a vehicle parking platform which is movable along the stanchions. Articulated stabilizing bar assemblies extend from the parking platform to the base. Each articulated stabilizing bar assembly comprises a rocker arm and a control arm which are articulated to one another. The rocker arm is further articulated to the parking platform, and the control arm is articulated to the base.

The vehicle parking apparatus disclosed in U.S. Pat. No. 4,772,172 further includes a pair of piston and cylinder assemblies pivotally mounted to portions of the articulated stabilizing bar assembly. The connection of the piston and cylinder assembly to the articulated stabilizing bar assembly may be such that the maximum extension of the piston and cylinder assembly substantially corresponds to the alignment of the stabilizing bar assembly in the lowest position of the parking platform. Conversely, the connection of the piston and cylinder assembly with the articulated stabilizing bar assembly may be such that the piston will be fully retracted within the cylinder when the stabilizing bar assembly is in the fully elevated position of the parking platform.

The above described connections enable a relatively small movement of the piston to achieve a relatively great movement of the parking platform. Consequently, the parking apparatus disclosed on U.S. Pat. No. 4,772,172 achieves the extremely desirable attribute of having a very low profile to enable the use of the parking apparatus within indoor parking facilities that previously could not accept such parking devices. More particularly, the maximum height of the prior art vehicle parking apparatus when in use is substantially define by the top of the vehicle on the elevated platform. Thus, the apparatus of U.S. Pat. No. 4,772,172 with an elevated vehicle thereon may assume a maximum height of between approximately 9.5' and 10'.

Although the low profile vehicle parking apparatus disclosed in U.S. Pat. No. 4,772,172 is extremely desirable for use in most indoor parking facilities, there are certain indoor facilities that may have maximum height restrictions which are less than 9.5'. Hence, in such facilities the vehicle parking apparatus disclosed in U.S. Pat. No. 4,772,172 could not be used because the elevated vehicle on the platform would surpass the maximum allowable height of the facility.

Therefore, it is an object of the subject invention to provide a new and improved vehicle parking apparatus having means for adjusting the height of the vehicle platform with the vehicle thereon such that the apparatus, with an elevated vehicle thereon assumes a height of approximately 8.0' which is approximately equal to the height of the apparatus itself.

SUMMARY OF THE INVENTION

The height adjustable vehicle parking apparatus of the subject invention basically comprises a pair of stanchions which extend rigidly upward from a base, a vehicle parking platform which is movable along the stanchions, a support member rigidly mounted at one of several optional elevations and a latch mechanism selectively engageable with the support member for locking the vehicle platform at a selected height depending upon the structural limitations of the facility in which the apparatus is employed.

The adjustable support which is operative with a latch means for locking the vehicle platform at intermediate elevated heights may be detachably connected to intermediate mounting flanges disposed on each of the stanchions. Alternatively, the adjustable support may be detachably connected to upper mounting flanges disposed adjacent the top end of each of the stanchions for locking the vehicle platform at a maximum elevation for employment in indoor facilities in which height limitations are less restrictive.

The subject invention further includes articulated stabilizing bar assemblies which extend from the vehicle platform to the base of the apparatus. The stabilizing bar assemblies each comprise a rocker arm and a control arm being articulated to one another. The rocker arm is further articulated to the vehicle platform, and the control arm is articulated to the base of the apparatus. The height adjustable vehicle parking apparatus further comprises a pair of piston and cylinder assemblies each having a first end pivotally mounted to the stanchion, and a second end pivotally mounted to a portion of the rocker arm spaced from the parking platform and from the control arm.

The connection of the piston and cylinder assembly to the articulated stabilizing bar assembly may be such that the maximum extension of the piston and cylinder assembly substantially corresponds to the alignment of the stabilizing bar assembly in the lowest position of the parking platform. Conversely, the connections of the piston and cylinder assembly with the articulated stabilizing bar assembly may be such that the piston will be fully retracted within the cylinder when the stabilizing bar assembly is in the fully elevated position of the parking platform.

Accordingly, the connections of the piston and cylinder assembly with the articulated stabilizing bar assembly may be such that the piston will be partially retracted within the cylinder when the stabilizing bar assembly is in intermediate elevated positions of the parking platform. At such a time, the parking platform may be locked at one of several intermediate heights, with the vehicle thereon so as to enable the apparatus to be employed in various indoor parking facilities having different height accommodations.

DETAILED DESCRIPTION OF THE PREFERRED EMBODIMENT

Figure 1:
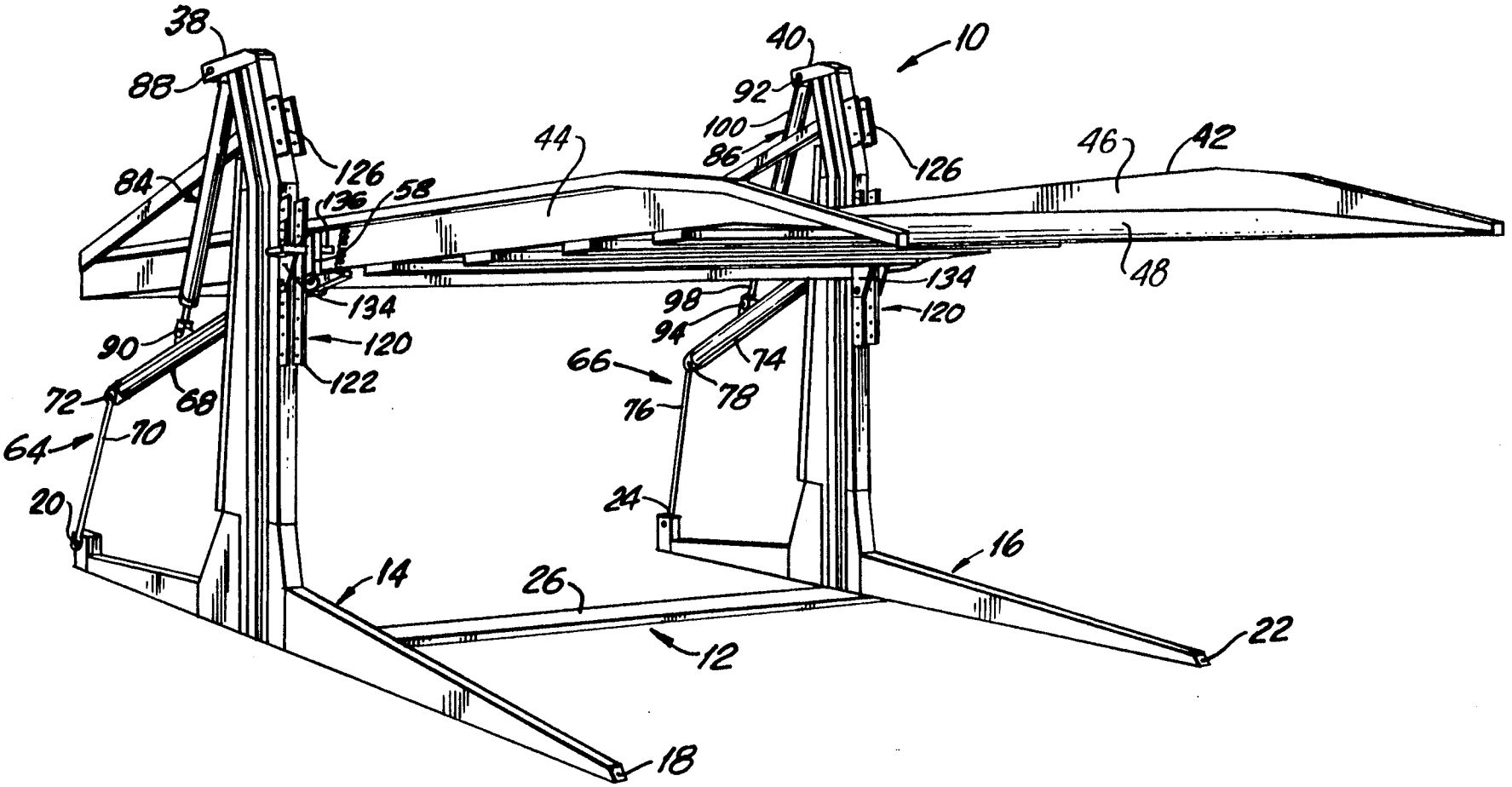
FIG. 1 is a perspective view of the height adjustable vehicle parking apparatus of the subject invention.

The height adjustable vehicle parking apparatus of the subject invention is illustrated in FIG. 1 and is designated generally by reference numeral 10. The height adjustable vehicle apparatus 10 includes a base 12 which comprises first and second longitudinally extending support legs 14 and 16 which are disposed in spaced parallel relationship to one another as shown in FIG. 1. More particularly, the distance between the longitudinally extending support legs 14 and 16 is selected to exceed the maximum anticipated width of any vehicle to be parked on the apparatus 10. The longitudinally extending support leg 14 includes opposed front and rear ends 18 and 20, while the longitudinally extending support leg 16 includes opposed front and rear ends 22 and 24. The length defined by the respective longitudinal support legs 14 and 16 typically will be selected to be slightly less than the overall length of a vehicle to be parked on the apparatus 10.

The base 12 further includes a transverse support 26 which extends between and connects the respective longitudinal support legs 14 and 16. More particularly, the transverse support 26 is rigidly joined to the longitudinal supports 14 and 16 at locations intermediate the respective front ends 18 and 22 and rear ends 20 and 24 thereof respectively. The transverse support 26 is dimensioned and configured to have a low profile to permit a vehicle to be readily driven over the transverse support 26 at a low speed.

The height adjustable parking apparatus 10 further includes a pair of upstanding stanchions 34 and 36 which are rigidly connected to and extend from the respective longitudinal support legs 14 and 16 of the base 12. More particularly, the stanchions 34 and 36 extend substantially perpendicularly from the longitudinal support legs 14 and 16. However, the ends 38 and 40 of the stanchions 34 and 36 remote the longitudinal supports 14 and 16 are angled in a rearward direction. This rearward angle of ends 38 and 40 of the stanchions 34 and 36 ensures a proper rearward sloping of a vehicle elevated by the apparatus 10 as explained herein. Additionally, the stanchions 34 and 36 preferably are configured to define track means as explained in the above cited U.S. Pat. No. 4,209,276, the disclosure of which is incorporated herein by reference.

The height adjustable parking apparatus 10 further comprises a parking platform 42 which is mounted for movement along the stanchions 34 and 36. More particularly, the parking platform 42 includes a pair of longitudinally extending side rails 44 and 46 respectively and a central plate 48. The central plate 48 defines the surface on which a vehicle is parked and supported for elevation by the apparatus 10. The parking platform 42 further comprises follower means 54 and 56 for positively engaging and facilitating movement of the parking platform 42 relative to the stanchions 34 and 36. The follower means 54 and 56 may comprise wheels which are dimensioned to positively engage corresponding channels in the stanchions 34 and 36 in the manner described in the above cited U.S. Pat. No. 4,209,276. The follower means 54 and 56 are specifically adapted to follow the angled ends 38 and 40 of the stanchions 34 and 36 to permit a tilting of the platform 42 as it approaches its uppermost position.

Figure 2:
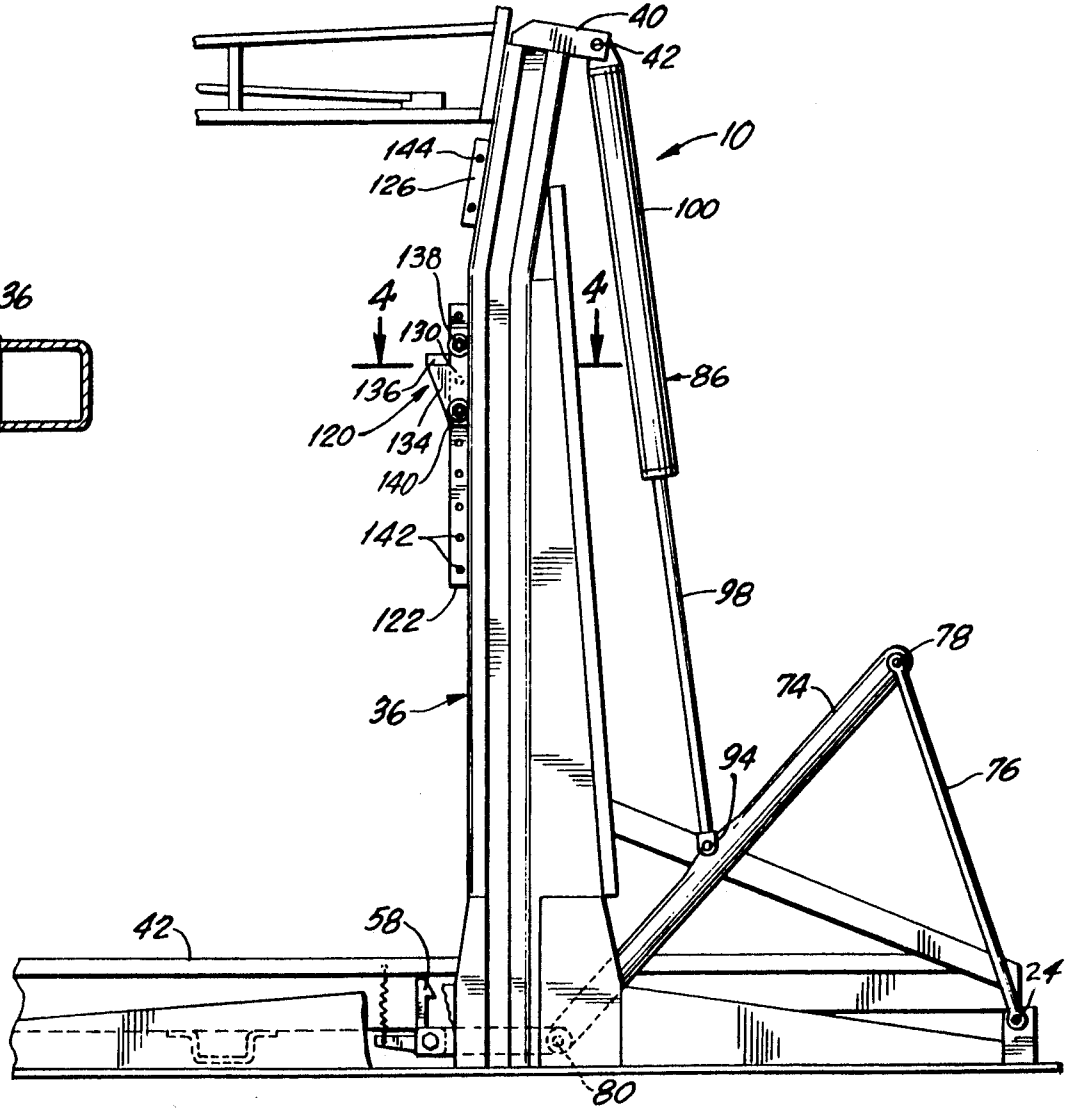
FIG. 2 is a side elevational view of a portion of the height adjustable vehicle parking apparatus of the subject invention in its lowest operational position.
Figure 4:
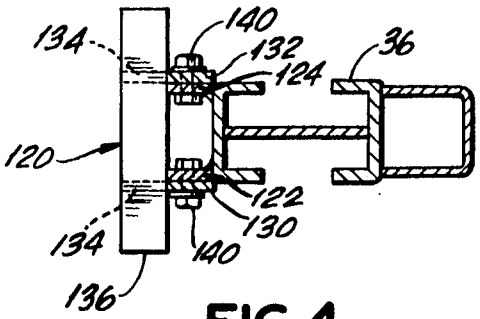
FIG. 4 is a cross-sectional view taken along line 4—4 in FIG. 2 of the height adjusting means of the vehicle parking apparatus of the subject invention.
Figure 3:
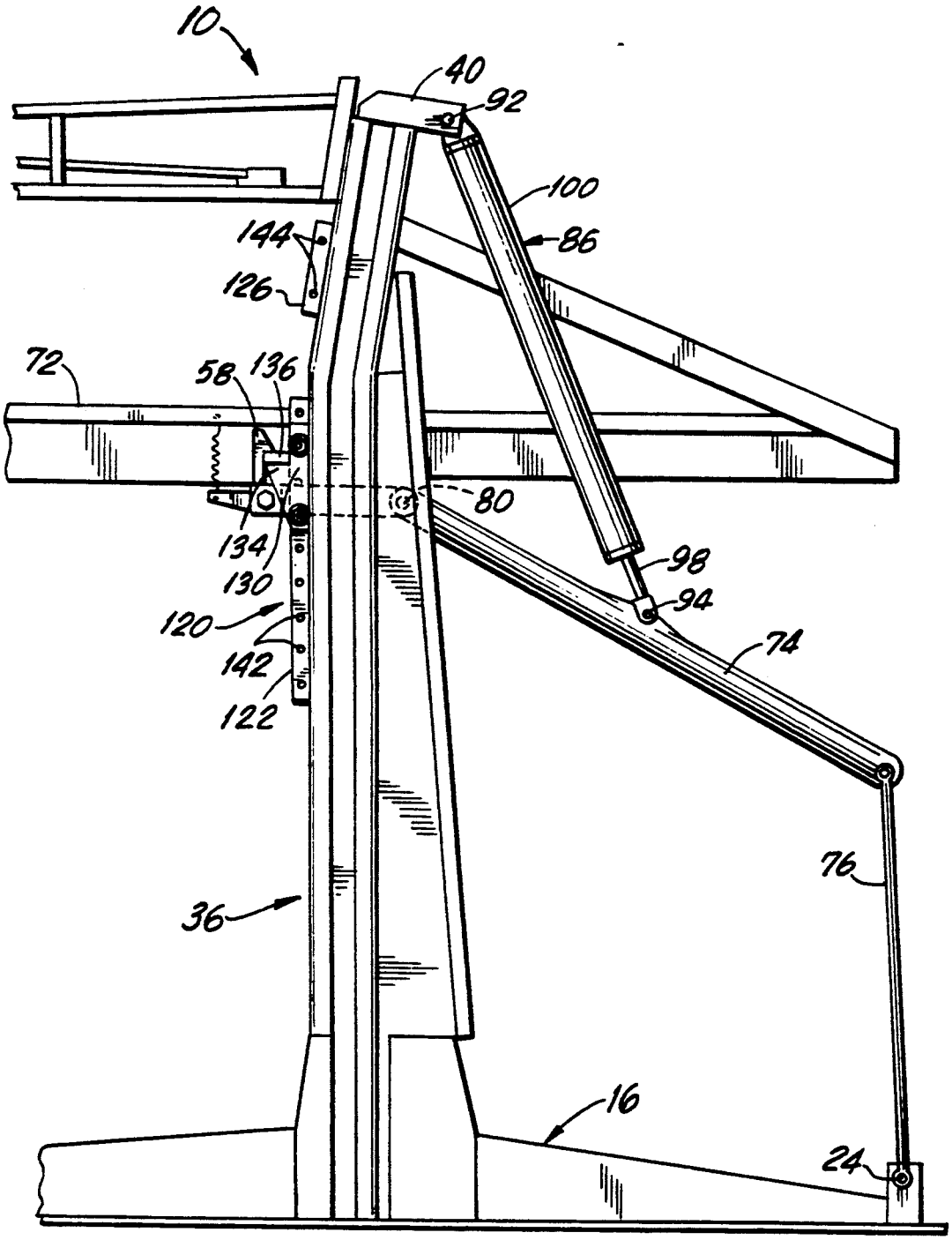
FIG. 3 is a side elevational view of a portion of the vehicle parking apparatus of the subject invention in its highest operational position.

The parking platform 42 further includes latch means 58 mounted adjacent the side rails 46, as shown in FIGS. 2 and 3 for locking the vehicle platform 42 in a desired elevated condition. The latch means 58 is operative to engage an adjustable support 120 which may be detachably connected to a pair of intermediate mounting flanges 122 and 124 disposed at an intermediate elevation along the stanchion 36 as shown in FIGS. 2 through 4, or alternatively to a pair of upper mounting flanges 126 and 128 disposed adjacent the top end 40 of the stanchion 36 as shown in FIGS. 2 and 3. The adjustable support 120 comprises a pair of parallel legs 130 and 132, each having an outwardly extending wedge 134, upon which a horizontal engaging beam 136 is rigidly attached. The horizontal engaging beam 136 is particularly dimensioned to lockingly accept the latch means 58 at a location intermediate parallel legs 130 and 132. The parallel legs 130 and 132 of the adjustable support 120 both include a pair of corresponding spaced apart bolt holes 138 for receiving fastening means 140. Upon engaging the latch means 58 with the horizontal engaging beam 136, the adjustable support 120 is subjected to loads in excess of 3500 lbs. that create tensile stresses on the legs 130 and 132 and compressive stresses on the wedges 134. More particularly, upon loading engaging beam 136 the adjustable support 120 is subjected to a bending moment. Therefore, the placement of one of the bolt holes 138 above the horizontal engaging beam 136 and one below is intended to effectively resist the bending moment associated with the loading of the engaging beam 136 and thus preclude any and all deformation of the adjustable support.

The intermediate mounting flanges 122 and 124 include a plurality of spaced a part bolt holes 142 which correspond to the bolt holes 134 included in the parallel legs 130 and 132 of the adjustable support 120. The upper mounting flanges 126 and 128 each include a pair of spaced apart bolt holes 144 corresponding to the bolt holes 138 included in the adjustable support 120. The adjustable support 120 may be detachably connected to either the intermediate mounting flanges 122 and 124 or the upper mounting flanges 126 and 128 by fastening means 138 depending upon the structural height limitations of the indoor parking facility in which the height adjustable parking apparatus 10 is employed. Thus, the latch means 58 is operative to mechanically engage the adjustable support 120 to keep the parking platform 42 in an elevated condition at a plurality of intermediate heights approximately between 6.0' and 8.0' feet. The latch means 58 may be selectively released when a vehicle on the parking platform 42 is to be lowered. Similar latch means, locking supports, and mounting flanges may be provided adjacent the stanchion 34.

The height adjustable vehicle parking apparatus 10 further comprises articulated stabilizing bar assemblies 64 and 66 which contribute to the efficient and even lifting and lowering of the parking platform 42. More particularly, the articulated stabilizing bar assembly 64 extends between the side rail 54 and the longitudinal support 14. While the articulated stabilizing bar assembly 66 extends between the side rail 46 and the longitudinal support 16.

The articulated stabilizer bar assembly 64 comprises a rocker arm 68 and a control arm 70 which are articulated to one another at pivot point 72. The rocker arm 68 is pivotally connected to the side rail 54, while the control arm 70, is pivotally connected to the longitudinal support 14 adjacent rear end 20 thereof. In a similar manner, the articulated stabilizer bar assembly 66 comprises rocker arm 74 and control arm 76 which are articulated to one another at point 78. The rocker arm 74 is further pivotally connected to the side rail 46 at pivot point 80 as shown in FIGS. 2 through 4, while the control arm 76 is pivotally connected to the longitudinal support 16 adjacent the rear end 24 thereof.

The raising and lowering of the parking platform 42 is achieved by substantially identical piston and cylinder assemblies 84 and 86 shown in FIG. 1. The piston and cylinder assembly 84 extends from pivot point 88 adjacent the top end 38 of the stanchion 34 to pivot point 90 on the rocker arm 68. The piston and cylinder assembly 88 extends from a pivot point 92 adjacent the top end 40 of the stanchion 36 to pivot point 94 on rocker arm 74.

The piston and cylinder assemblies 84 and 86 undergo substantially identical simultaneous operation to raise and lower the parking platform 42. In particular, the piston and cylinder assembly 86 comprises a piston 98 slidably disposed within a hydraulic cylinder 100. The cylinder 100 is pivotally connected to the top end 40 of stanchion 36 at pivot point 92. Similarly, the piston 98 is pivotally connected to the rocker arm 74 at pivot point 94, which is located approximately mid-way along the length of the rocker arm 74.

The slidable advancement of the piston 98 out of the cylinder 100 causes the pivot point 94 on the rocker arm 74 to move downwardly. Conversely, the slidable retraction of the piston 98 into the cylinder 100 causes the pivot point 94 on the rocker arm 74 to advance upwardly. However, the movement of the rocker arm 74 is limited and positively controlled by the pivotal connection to the control arm 76 at pivot point 78. More particularly, the movement of the pivot point 94 under the action of the piston 98 will cause a substantial pivotal movement of the rocker arm 74 about pivot point 78. The relative radial position of pivot points 80 and 94 with respect to pivot point 78 cause the pivot point 80 to move a greater distance than pivot point 94 as the rocker arm 74 moves through an arc around the pivot point 78. Thus, any movement of the piston 98 will cause a substantially greater movement of pivot point 80. As noted above, the pivot point 80 is attached to the side rail 46 of parking platform 42 which in turn is movable along stanchion 36. Consequently, any movement of piston 98 will cause a substantially greater movement of the parking platform up or down along stanchions 34 and 36. The maximum extension of piston 98 will cause pivot point 80 and parking platform 42 to move completely down into proximity with longitudinal support 16 as shown in FIG. 2. In this condition, the parking platform 42 will be in a position to receive a vehicle thereon.

The vehicle will be raised by the retraction of piston 98 into the cylinder 100 under appropriately applied hydraulic force. As the piston 98 is retracted both the pivot point 80 and the pivot point 94 will advance upwardly. However, the pivot point 80 will move a substantially greater distance in view of the relative difference in distance of pivot points 80 and 94 from pivot point 78. When the piston 98 has been partially retracted to a sufficient position in the cylinder 96 the vehicle platform will be in an intermediate elevated condition relative to stanchion 34. At such a time, the latch means 58 on the vehicle platform 42 may be detachably engaged to the adjustable support 120 fastened to the intermediate mounting flanges 122 and 124 on the stanchion 36. Accordingly, when piston 98 achieves its fully retracted position in cylinder 96, the platform 42 will be in a fully elevated position relative to the stanchion 34 as shown in FIG. 3. At such a time, the latch means 58 on the vehicle platform 42 may be detachably engaged to the adjustable support 120 fastened to the upper mounting flanges 126 and 128 on the stanchion 36.

As explained above, the parking apparatus 10 performs the lifting work during the pulling strokes of the piston and cylinder assemblies 84 and 86. The relative locations of the pivot points along the rocker arm 68 and 74 enables the piston and cylinder assemblies 84 and 86 to lift the parking platform a distance approximately twice the maximum movement of the respective pistons. Thus, the linkage between the piston and cylinder assemblies 84 and 86 and the respective articulated stabilizer arms 64 and 66 enables the parking platform 42 to be raised to the required elevation by an apparatus that does not exceed the height of the stanchions 34 and 36. Furthermore, the lifting forces ar applied through the same mechanism that stabilized the parking platform 42. In particular, the piston and cylinder assemblies 84 and 86 are attached to the articulated stabilizing bar assemblies 64 and 66 and contribute to stabilization of the parking platform 42. By pulling on the articulated stabilizing bar assemblies 64 and 66 the parking apparatus 10 ensures a high degree of stabilization through the lifting process.

In the preferred embodiment as illustrated in FIGS. 2 and 3, the rocker arm 74 comprises a central beam 102 which is substantially rectangular in cross section, a pair of flanges 104 and 106 securely attached to opposed longitudinal sides of the beam 102. The flanges 104 and 106 have a greater height than the beam 102 to define a longitudinally extending channel 108 between the flanges 104 and 106 and the beam 102. The flanges 104 and 106 are provided with generally circular apertures 110 and 112 respectively extending through portions thereof which define the channel 108. The piston 108 terminates at end 114 and also is provided with an aperture 116 extending therethrough. An appropriate fastening means, such as bolt 118, extends through the apertures 110, 112 and 116 to securely but pivotally connect the piston 98 to the rocker arm 74. In this embodiment, the flanges 104 and 106 contribute to the strength and stability of the rocker arm 74. Additionally, the channel 108 defines an area into which portions of the piston 98 may rotate as the piston 98 approaches its fully retracted position corresponding to the maximum elevation of the parking platform 42.

In summary, a height adjustable vehicle parking apparatus is provided. The parking apparatus includes a base and a pair of upstanding stanchions. A parking platform is disposed intermediate the stanchions and can be raised or lowered along the stanchions. An adjustable support member is operative with a latch means for locking the vehicle platform at various elevated heights. A pair of articulated stabilizer bar assemblies extend between the base and the parking platform to provide stabilized movement of parking platform. Each articulated stabilizer bar assembly comprises a rocker arm pivotally connected to the parking platform and a control arm pivotally connected to both the base and the end of the rocker arm remote the parking platform. Piston and cylinder assemblies are connected to the ends and the stanchions remote from the base and to the respective rocker arms. The full extension of the pistons from the cylinders moves the parking platform into the fully lowered position while the retraction of the pistons into the cylinder raises the parking platform to its maximum elevation. Accordingly, partial extensions of the pistons from the cylinders moves the parking platform into intermediate elevations. The forces exerted by the piston and cylinder assemblies act through the articulated stabilizer bar assemblies to further enhance the stabilization.

While the invention has been described with respect to a preferred embodiment, it is apparent that various changes can be made without departing from the scope of the invention as defined by the appended claims.

I claim:

1. A vehicle parking apparatus comprising:

a base;

a pair of spaced apart upstanding stanchions rigidly connected to said base;

a vehicle parking platform disposed intermediate said stanchions and movable along said stanchions between a first position substantially adjacent said base and a second position remote from said base;

means for raising and lowering said vehicle parking platform comprising a pair of piston and cylinder assemblies;

flange members rigidly connected to each of said stanchions at locations intermediate said first and second positions;

a rigid support member comprising a pair of parallel legs connected at one end by an engaging beam, said parallel legs being connectable to said flange members at any of a plurality of locations intermediate said first and second positions along said flange member; and latch means connected to said vehicle parking platform and being dimensioned to be detachably engaged with said engaging beam, whereby said vehicle parking platform may be elevated to a selected height along said flange member intermediate said first and second positions and thereafter support at said selected height by the engagement of said latch means and said rigid support member such that said latch means detachably engages with said engaging beam when said parking platform is raised to the level at which said engaging beam is connected to said flange member.

2. A vehicle parking apparatus, including a pair of upstanding stanchions having opposed top and bottom ends, with the bottom ends being rigidly connected to a base, a parking platform including latch means and disposed intermediate said stanchions, said parking platform being movable along said stanchions between a first position adjacent said base and a second elevated position adjacent the top end of said stanchions, and further including a pair of articulated stabilizing bar assemblies, each comprising a rocker arm and a control arm and having a pair of piston and cylinder assemblies, each piston and cylinder assembly being pivotally mounted to said base at one end and said rocker arm at a second end for raising and lowering the parking platform, the improvement comprising: height adjustable means for supporting said vehicle platform at intermediate heights between said first position adjacent said base and said second position adjacent the top of said stanchions, wherein said height adjustable means for supporting said vehicle platform comprises a flange member which is rigidly connected to each of said stanchions and is disposed intermediate said first position adjacent said base and said second position, said height adjustable means further including a rigid member which includes a pair of parallel legs connected at one end by a cross-beam, said rigid member being fastened to said flange member and positioned thereon at any one of a plurality of locations intermediate said first and second positions along said flange member whereby said latch means of said parking platform may detachably engage said cross-beam of said rigid support members so as to lock said parking platform at an intermediate height along said flange member between said first position adjacent said base and said second position adjacent the top end of said upstanding stanchions.

3. A vehicle parking apparatus comprising:

a base;

a pair of spaced apart upstanding stanchions rigidly connected to said base;

a vehicle parking platform disposed intermediate said stanchions and movable along said stanchions between a first position substantially adjacent said base and a second position remote from said base;

means for raising and lowering said vehicle parking platform;

height adjustable support means for supporting said vehicle parking platform at intermediate heights between said first position adjacent said base and second position elevated from said base comprising an engaging beam having a pair of parallel legs rigidly connected to said engaging beam and with a flange means connected to said stanchion for selectively mounting said parallel legs and engaging beam adjacent said stanchions at any of a plurality of locations intermediate said first and second positions along said flange means; and latch means connected to said vehicle parking platform and selectively engageable with said height adjustable support means such that said latch means may detachedly engage said engaging beam so as to lock said vehicle parking platform at an intermediate height along said flange means between said first position adjacent said base and said second position remote from said base.

4. A parking apparatus as in claim 3 wherein said engaging beam is disposed perpendicular to said pair of parallel legs.

5. A parking apparatus as in claim 3 wherein said parallel legs may be selectively mounted to opposed lateral sides of said stanchion.

6. A parking platform as in claim 3 wherein said parallel legs include a bolt hole above said engaging beam and a bolt hole below said engaging beam so as to be used as a fastening means to mount said rigid engaging beam to said upstanding stanchion.

* * * * *